US008006694B2

(12) United States Patent
Marx

(10) Patent No.: US 8,006,694 B2
(45) Date of Patent: Aug. 30, 2011

(54) POP-OPEN RESPIRATORY ETIQUETTE DEVICE

(76) Inventor: Gustav David Marx, Thornhill (CA)

( * ) Notice: Subject to any disclaimer, the term of this patent is extended or adjusted under 35 U.S.C. 154(b) by 217 days.

(21) Appl. No.: 12/457,608

(22) Filed: Jun. 17, 2009

(65) Prior Publication Data

US 2010/0229871 A1 Sep. 16, 2010

(51) Int. Cl.
*A62B 18/08* (2006.01)

(52) U.S. Cl. ..... 128/203.19; 128/206.25; 128/205.27; 128/206.14; 128/206.19

(58) Field of Classification Search ..... 128/202.24, 128/202.13, 205.25, 205.27, 206.14, 206.19, 128/206.25, 203.19, 863; 2/206, 9
See application file for complete search history.

(56) References Cited

U.S. PATENT DOCUMENTS

| | | | |
|---|---|---|---|
| 2,201,315 | A | 5/1940 | Lehmberg |
| 2,378,929 | A | 6/1945 | Joyce |
| 2,983,271 | A | 5/1961 | Beck |
| 3,220,409 | A | 11/1965 | Liloia et al. |
| 3,438,370 | A | 4/1969 | Krantz, Jr. |
| 3,719,188 | A | 3/1973 | Fisher et al. |
| 4,004,584 | A | 1/1977 | Geaney |
| 4,600,420 | A | 7/1986 | Wydeven et al. |
| 4,628,927 | A | 12/1986 | Ward |
| 4,850,347 | A | 7/1989 | Skov |
| 5,357,947 | A | 10/1994 | Adler |
| 5,372,130 | A | 12/1994 | Stern et al. |
| 5,413,094 | A | 5/1995 | McBrearty |
| 5,427,092 | A | 6/1995 | Shiao |
| 5,538,013 | A | 7/1996 | Brannon |
| 5,647,377 | A | 7/1997 | Shinabarger |
| 5,701,893 | A | 12/1997 | Kern et al. |
| 5,992,414 | A | 11/1999 | Tayebi et al. |
| 6,085,864 | A | 7/2000 | Copeland et al. |
| 6,394,090 | B1 | 5/2002 | Chen et al. |
| 6,474,336 | B1 | 11/2002 | Wolfe |
| 6,868,984 | B2 | 3/2005 | Griesbach et al. |
| 6,948,499 | B2 * | 9/2005 | Griesbach et al. ..... 128/206.25 |
| 2005/0194010 | A1 | 9/2005 | Sankot |
| 2006/0230485 | A1 | 10/2006 | Lee |

FOREIGN PATENT DOCUMENTS

| | | |
|---|---|---|
| WO | WO/2006/119610 | 11/2006 |
| WO | WO2009/070868 | 6/2009 |

OTHER PUBLICATIONS

PCT International Search Report and Written Opinion mailed Feb. 28, 2011 relating to PCT/CA2010/001053 (MARX).

* cited by examiner

*Primary Examiner* — Steven Douglas
(74) *Attorney, Agent, or Firm* — Bereskin & Parr LLP/S.E.N.C.R.L., s.r.l.

(57) ABSTRACT

A respiratory etiquette device in the form of a mask that can be held in a compacted configuration within the pocket or purse of a user. When released, the mask springs open to its erected configuration and can be quickly placed over the mouth and nose of a wearer to contain a cough or sneeze. Rapid springing open of the mask is achieved by using a plastic core having an array of external bubbles that rapidly regain their shape when the mask is released, thereby forcing the entire mask into its fully erected configuration.

8 Claims, 7 Drawing Sheets

Fig.1
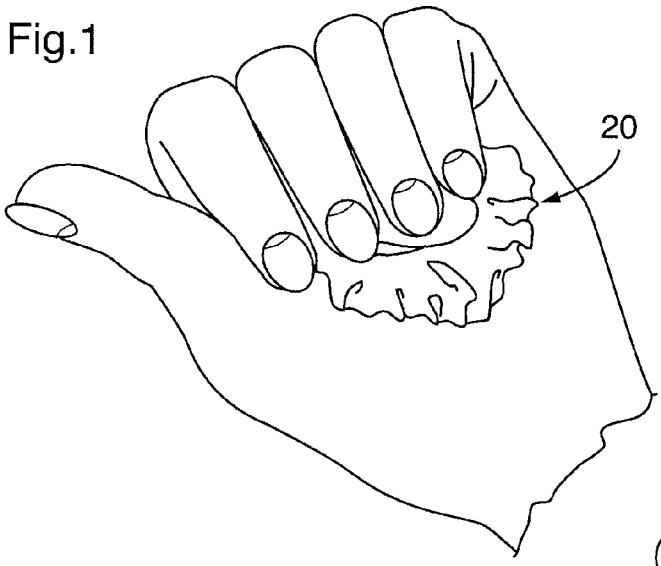
Fig.2
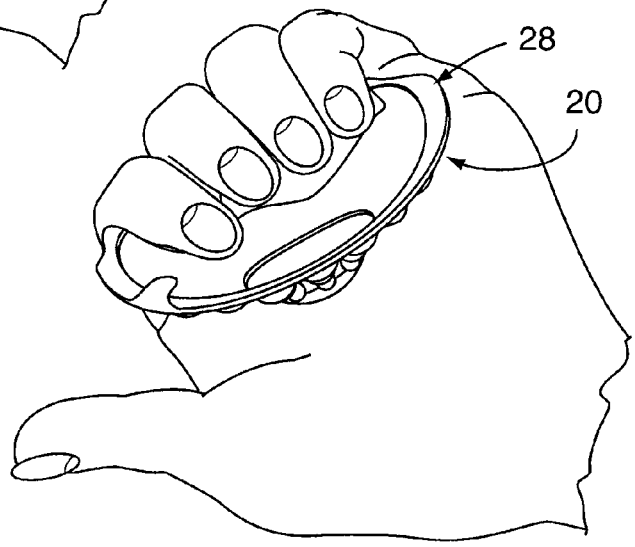
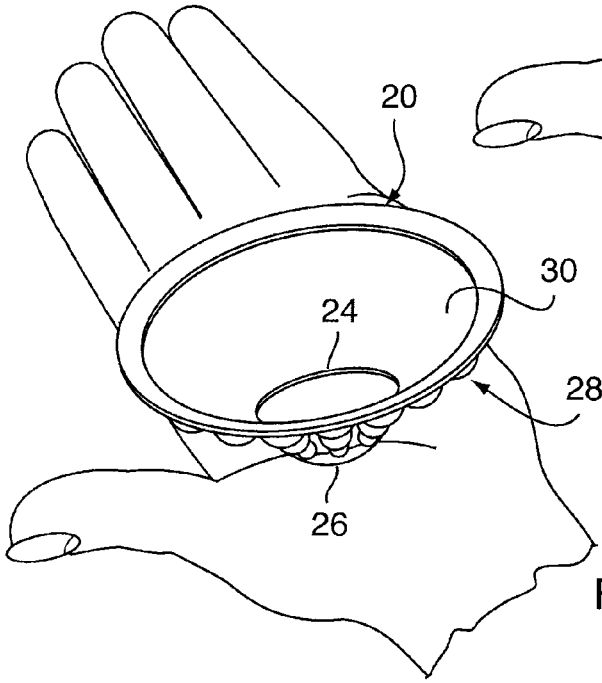
Fig.3

Fig.9
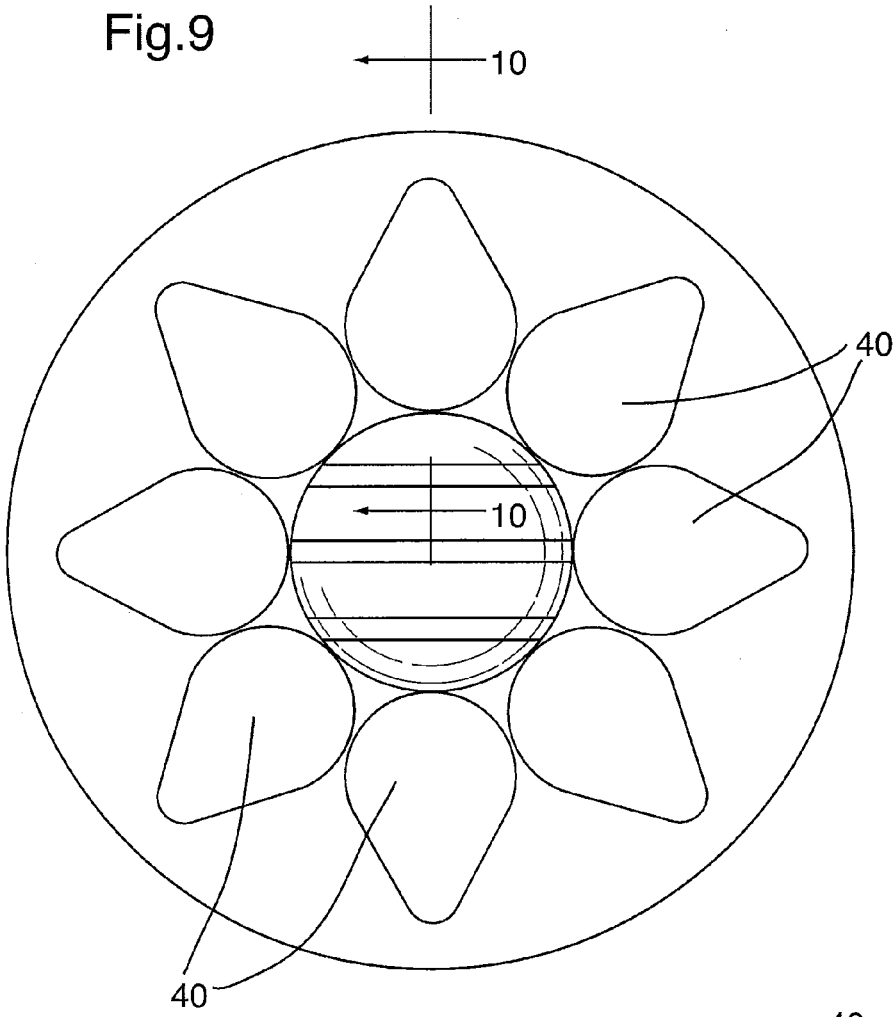
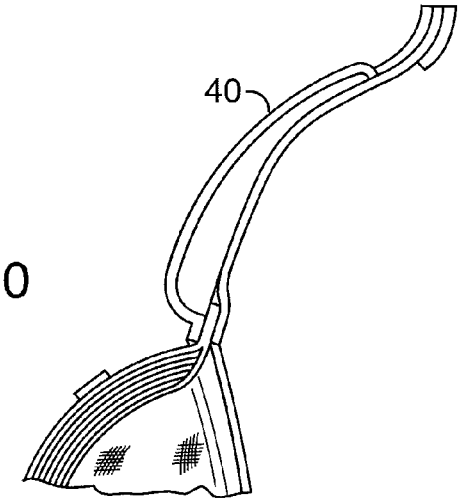
Fig.10

POP-OPEN RESPIRATORY ETIQUETTE DEVICE

FIELD OF THE INVENTION

This invention relates to what has become known as "respiratory etiquette", namely the practice of covering the mouth and nose when coughing or sneezing, as an aid to infection control and prevention of the spread of germs. In particular, the invention is concerned with a device intended to be used in practicing respiratory etiquette.

BACKGROUND OF THE INVENTION

A person who coughs or sneezes will often attempt to cover his or her mouth with a hand or possibly a tissue or handkerchief. At best, this may contain some of the droplets of saliva, mucus and the like that would otherwise be expelled into the surrounding air. While this may limit to some extent the spread of germs, it is obviously not an ideal solution. In fact, the problem may be exacerbated if the person uses a hand and does not immediately wash.

Another problem with using a handkerchief or a paper tissue is that it must be unfolded in order to be placed effectively over the mouth and nose. Sometimes, the reflex to cough or sneeze occurs before the handkerchief or tissue can be unfolded and placed exactly over the mouth and nose.

In times of public concern about the spread of disease, a few people may wear paper particle masks in an attempt to protect themselves. Such masks are awkward to put on and take off and unsightly in wear. The person typically will wear the mask continuously while in public. Further, a particle mask is designed to keep out particulate matter and protect the individual wearing the mask, rather than keep in germs and protect third parties.

WO/2006/119610 published Nov. 16, 2006 discloses a proposal by the present inventor for a personal hygiene device in the form of a mask that is crushable so that it can be accommodated in the pocket or purse and which, when released, springs open to an erected configuration in which it can be placed over the mouth and nose of the wearer.

An object of the present invention is to provide a device that represents an improvement on the device of WO/2006/119610.

SUMMARY OF THE INVENTION

The present invention provides a respiratory etiquette device in the form of a mask comprising a plastic core which is moulded in a shape for covering the mouth and nose of a wearer when the mask is in an erected configuration, the mask being crushable to a compacted configuration in which the mask can be constrained when not in use. The core has an outer surface formed with an array of raised areas for causing the mask to return to its erected configuration when unconstrained. The mask is impervious to outward expulsion of material from the mouth and/or nose of a user in sneezing or coughing and includes an opening that is closed by a filter for allowing release of excess air from a sneeze or cough.

The mask will normally be kept in a person's pocket or purse in its compacted configuration and will be withdrawn, allowing the mask to open to its erected configuration, when the user feels a sneeze or cough coming on. The mask is then placed over the nose and mouth. The impervious structure contains any material that is expelled from the nose and/or mouth of the wearer when the sneeze or cough actually occurs, while allowing excess air to be released through the filter.

When the mask is released to return to its erected configuration, the raised areas in the surface of the mask will quickly regain their original shapes, thereby forcing the entire mask into its fully erected configuration. The raised areas preferably have geometries shapes such as circular shapes, so that, in three dimensions, the areas form dome-shaped bubbles on the surface of the mask. Alternatively, the raised areas may form rings that encircle the mask. In any event, the raised areas preferably cover a substantial part of, if not the entire outer surface of the core. The raised areas may be interconnected with one another.

The core may be thermally formed in the erected, operative configuration from an extruded sheet or film. A paper or other absorbent lining preferably will be provided on the interior of the plastic core.

While various plastic materials may be used for the core, a polypropylene or polypropylene-based material may be preferred. For example, the material may comprise polypropylene compounded with rubber or a rubber-like material to improve flexibility and fracture resistance. The plastic mask sheet material may be approximately 10 thousands of an inch thick so as to compress with the same ease of hand pressure as would a paper tissue stored in a pocket or purse. If not for the array of raised surface areas moulded into the plastic mask, the mask would not assume its erected configuration when released from the user's hand. It would remain largely crumpled. The plastic mask needs to be thin enough to crumple and requires the raised surface areas to achieve its pop-open function.

In a preferred embodiment, the mask has a generally conical shape with an open end of circular overall shape having a diameter sufficient to fit over the nose and mouth of the wearer. Around its perimeter, the open end has an outwardly directed lip that may be curved in cross-section so as to provide a sealing surface for contact with the wearer's face. The circular shape has the advantage that the mask does not have to be turned to fit the wearer as would be the case if the mask had, for example, a contour to fit over the nose. Nevertheless, a mask with a nose contour is within the scope of the invention.

BRIEF DESCRIPTION OF THE DRAWINGS

In order that the invention may be more clearly understood, reference will now be made to the accompanying drawings which illustrate a particular preferred embodiment of the invention by way of example, and in which:

FIG. 1 is a perspective view showing a mask in accordance with a preferred embodiment of the invention constrained within the closed hand of a user;

FIGS. 2 and 3 are views following on sequentially from FIG. 1 showing the mask progressively opening to its erected configuration;

FIGS. 9 and 10 and FIGS. 11 and 12 are views corresponding to FIGS. 7 and 8 respectively illustrating further alternative configurations of raised areas.

DETAILED DESCRIPTION OF THE INVENTION

Figure 4:
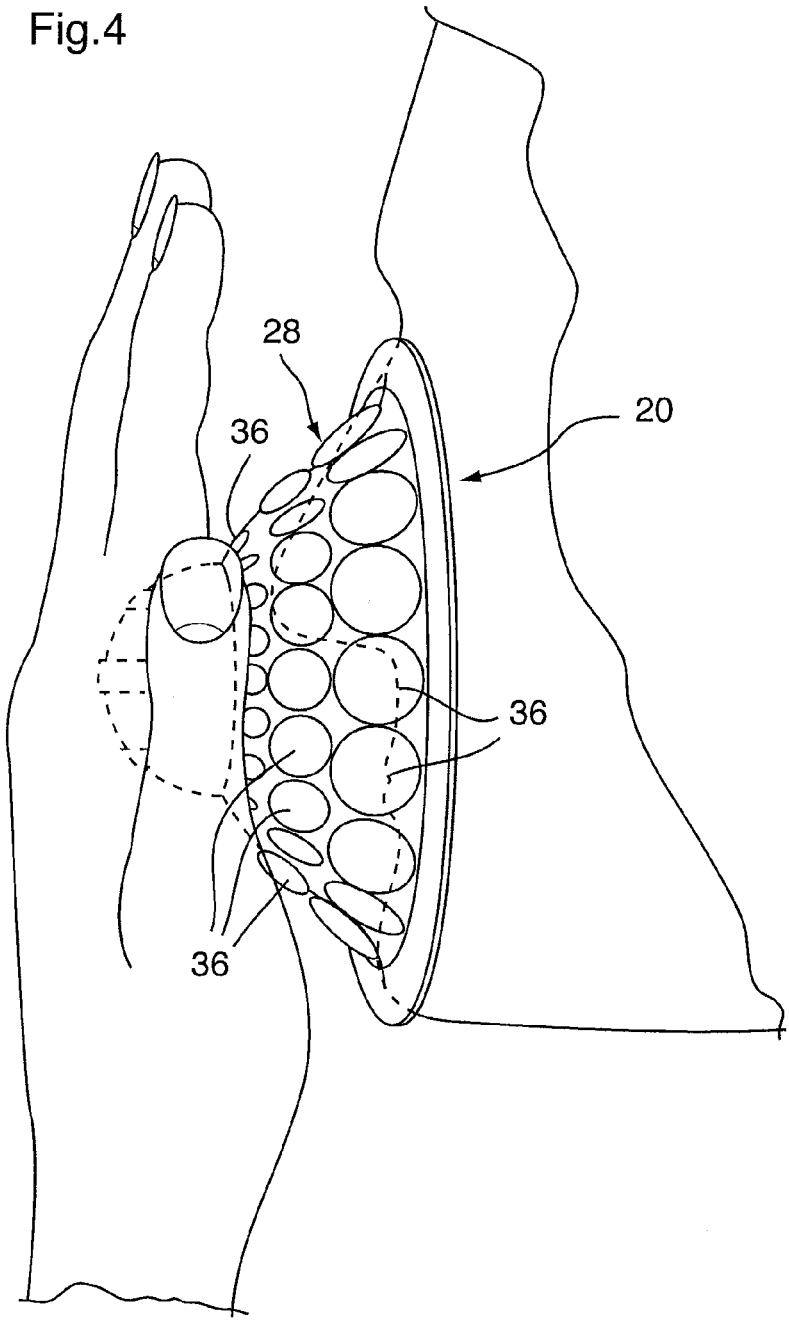
FIG. 4 shows the erected mask applied to the face of a user.

The drawings show a respiratory etiquette device in the form of a mask 20 that can adopt an erected, operative configuration (FIG. 4) and a compacted configuration (FIG. 1). In the compacted configuration, the mask can be accommodated in, for example, a pocket or purse of a user. The mask has a memory that tends to return the mask to its erected configuration when unrestrained. In other words, the mask will quickly "spring open" ready for use when withdrawn from the confines of a pocket, purse or the like.

In the erected configuration shown in FIGS. 2 to 5, the mask covers the mouth and nose of a wearer. As will be described in more detail, the mask is impervious to outward expulsion of material from the mouth and/or nose of the user in coughing or sneezing. At the same time, the mask has an opening 24 that is closed by a filter 26 for allowing release of excess air that results from the sneeze or cough. Typically, the mask opening 24 is of relatively large diameter, for example, about three inches.

The mask includes a plastic moulded core which is denoted by reference numeral 28. Preferably, the core is thermally formed from polypropylene film. The structure also includes an inner paper layer 30. The inner layer 30 should provide for some liquid absorbency and may be a woven paper material of the type typically used for conventional particle masks.

Core 28 is moulded in an appropriate generally conical shape with a circular open end having an outwardly curved marginal portion 28*a* (FIG. 6) that is contoured so that the mask fits comfortably against the face of the wearer. A resilient seal 32 is provided around the perimeter of the mask. The inner layer 30 of course follows the contours of the core.

In accordance with the invention, the core 28 has an outer surface formed with an array of raised areas for causing the mask to return to its erected configuration when unconstrained. In the embodiment of FIGS. 1 to 6, the raised areas are of circular shape as seen in elevation, forming domes or bubbles in the outer surface of the mask.

Figure 5:
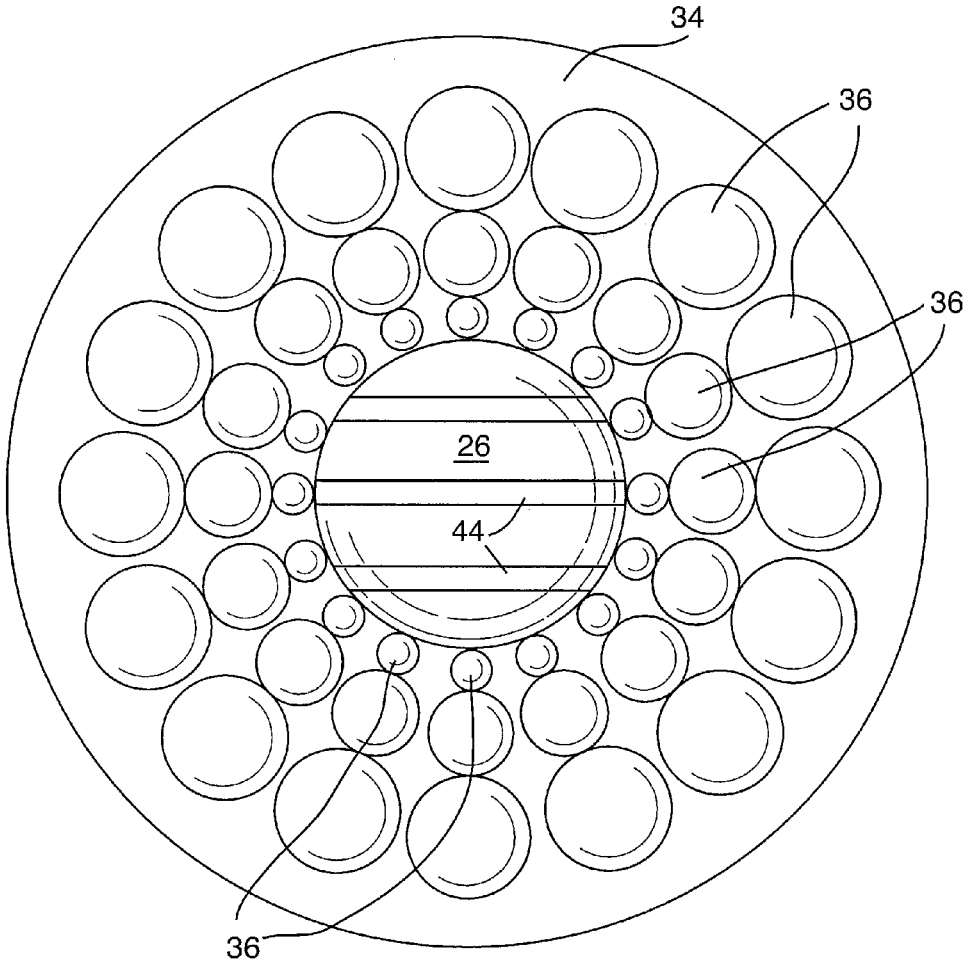
FIG. 5 is a front elevational view of the mask as seen in FIG. 4.

As seen in FIG. 5, the outer surface of the mask is denoted by reference numeral 34 and the individual raised areas are indicated at 36. In this particular embodiment, the raised areas or "bubbles" 36 are arranged concentrically around the central opening 24 in the core of the mask, in rings in which the bubbles are of increasing diameter in successive rings in the radially outward direction. This particular configuration is believed to have advantages in terms of providing an array of raised areas that cover substantially the entire outer surface 34 of the core. When the mask is released from its compacted configuration, for example as shown in FIGS. 2 and 3, the bubbles encourage a strong, quick expansion of the mask. As the hand opens, the individual bubbles will rapidly regain their shapes, thereby forcing the entire mask into its fully erected configuration. The raised areas will allow the mask to be made of a sufficiently thin plastic material to crumple easily for storage in a pocket, yet pop open when released from the user's hand pressure.

The raised areas may be relatively closely positioned, possibly in contact with one another, or may be spaced. Further, the raised areas may all be of the same size, or of different sizes as shown in FIG. 5. Different geometric shapes may be employed in the same mask.

Figure 8:
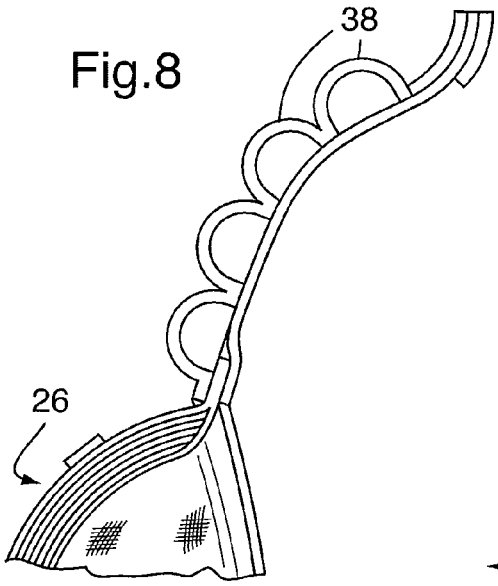
FIG. 8 is a sectional view on line 8-8 of FIG. 7.
Figure 7:
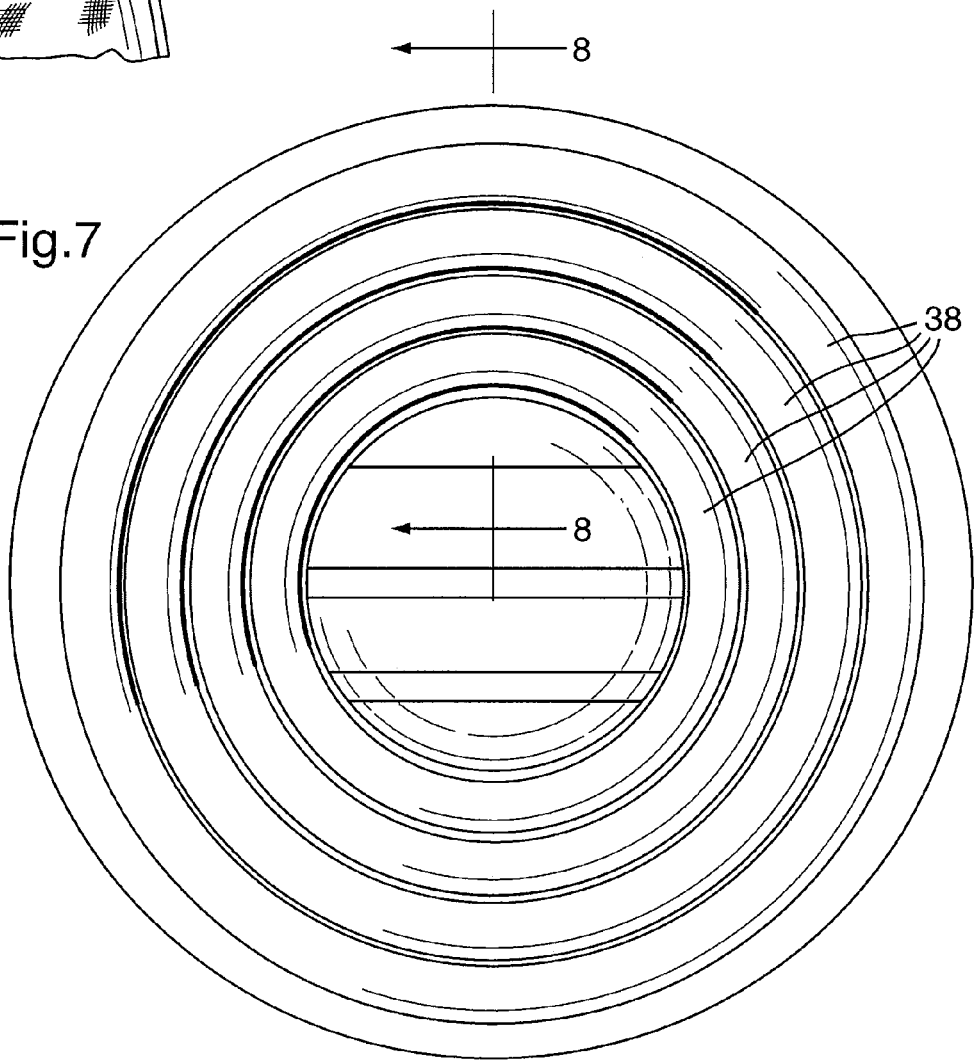
FIG. 7 is a front elevational view of a mask in accordance with an alternative embodiment, in which the raised areas are of annular shape.

FIGS. 7 to 12 illustrate other possible configurations of raised areas, but without limiting the scope of the invention. In the embodiment of FIGS. 7 and 8, the raised areas are of annular shape and closely abut one another as can be seen from FIG. 8. In an alternative embodiment, the annular areas could be separated from one another.

Figure 11:
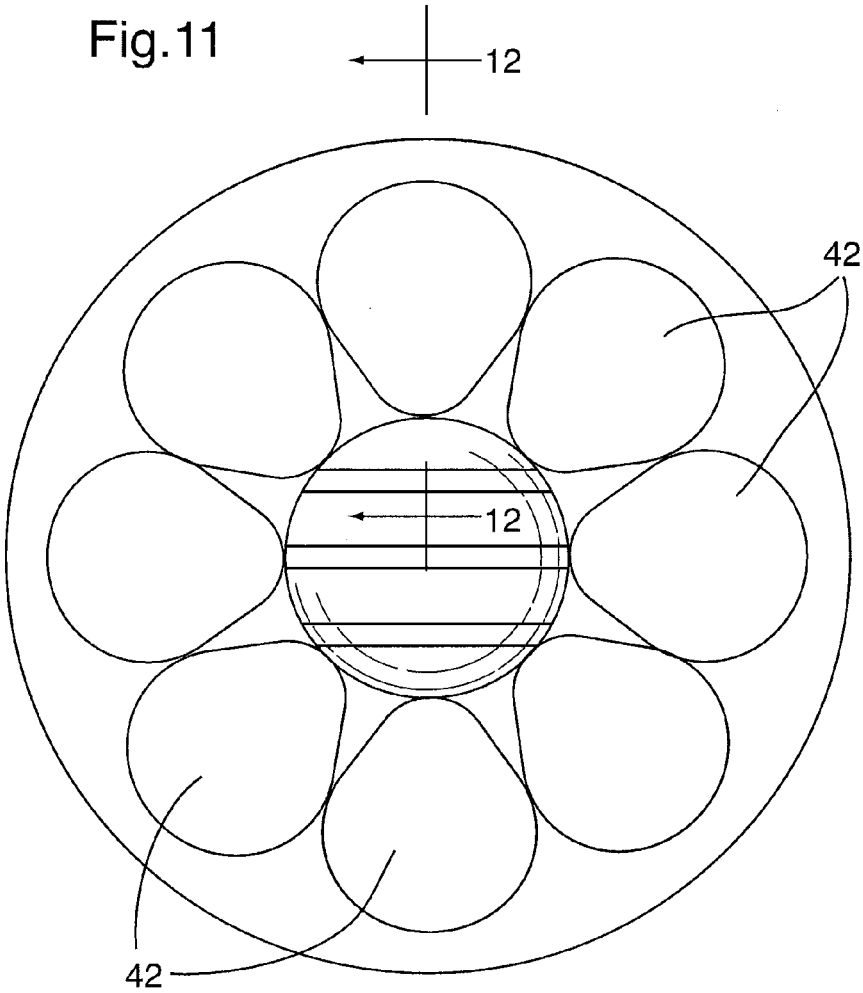
Figure 12:
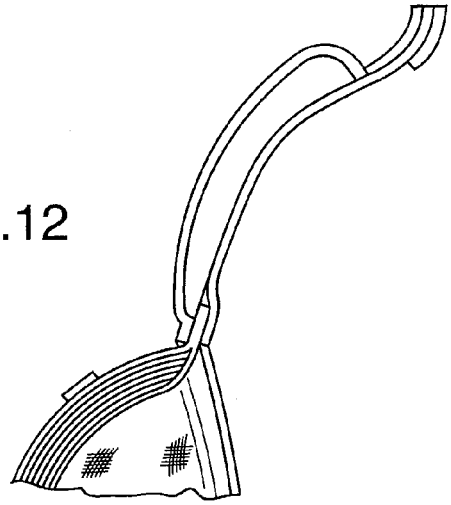

FIGS. 9 and 10 show a configuration in which the raised areas (denoted 40) are generally pear-shaped with the narrow ends of the "pears" facing outwardly. FIGS. 11 and 12 show a reverse arrangement in which the areas (denoted 42) are also pear-shaped but face inwardly. Again, the raised areas may be in contact with one another or they may be separated.

It is believed that, in all of the embodiments, it is the provision of these raised areas or "bubbles" in the outer surface of the mask that make for a fully functioning mask in which the core can be sufficiently thin to be easily crumpled or compacted, while the raised areas, when the mask is released, will rapidly regain their shape thereby forcing the entire mask to rapidly pop open.

The opening 24 in the core is shown as circular but this is not essential. In the illustrated embodiment, a series of spaced strips 44 of the polypropylene core material extend across the opening and provide surfaces against which the filter 26 bears so that the strips to some extent prevent the filter being blown out of the mask as a result of a particularly violent cough or sneeze. Obviously, the particular configuration of strips is not essential and may vary, or the strips may be replaced by a grid-like structure or other restraint means.

The filter 26 itself is shaped to match the shape of the opening 24. In the illustrated embodiment, filter 26 has a circular overall configuration and a loosely padded air pervious structure. In general, the overall appearance of the filter may be likened to a circular teabag. The precise structure of the filter may vary. For example, the filter may comprise inner and outer paper layers with a fibrous pad of absorbent material between the layers. The filter is glued or otherwise adhered to the polypropylene core of the mask around the perimeter of the filter and, preferably, along the strips 44.

In the particular embodiment illustrated, the strips 44 that restrain the filter 26 are curved outwardly to form a part-spherical dome or bulb-shaped filter "basket", and the filter 26 itself is correspondingly shaped. While the filter could be flat or follow the "natural" contour of the main body of the mask, it is believed that the bulb-shaped configuration described is preferred. For example, the strips 44 then form a "pocket" into which the filter 26 fits. The filter will tend to naturally remain in place in the pocket, although it is intended that the filter will still be glued to the strips 44.

It is believed that the provision of a bulb-shaped filter basket also is advantageous in terms of avoiding any resistance to compaction or "crushing" of the mask when the mask is to be placed in the pocket or purse of a user. Further, any obstruction or impediment to movement of air within the mask is minimized. At the same time, the bulb-shaped filter basket will provide a natural convexly curved external shape so that the palm of the user's hand will fit naturally around the mask and hold the mask to the user's face.

As noted previously, the core of the mask is preferably made of a polypropylene or polypropylene-based material. In any event, the material should be engineered to have a "no break" rating in accordance with industry standards for plastic mouldings; i.e. the material should not break or crack when the mask is crushed. Preferably, the material has a rating of between 10 and 15 in accordance with the standard "Izod" engineering test for rating the flexibility and breakability of plastic.

Figure 6:
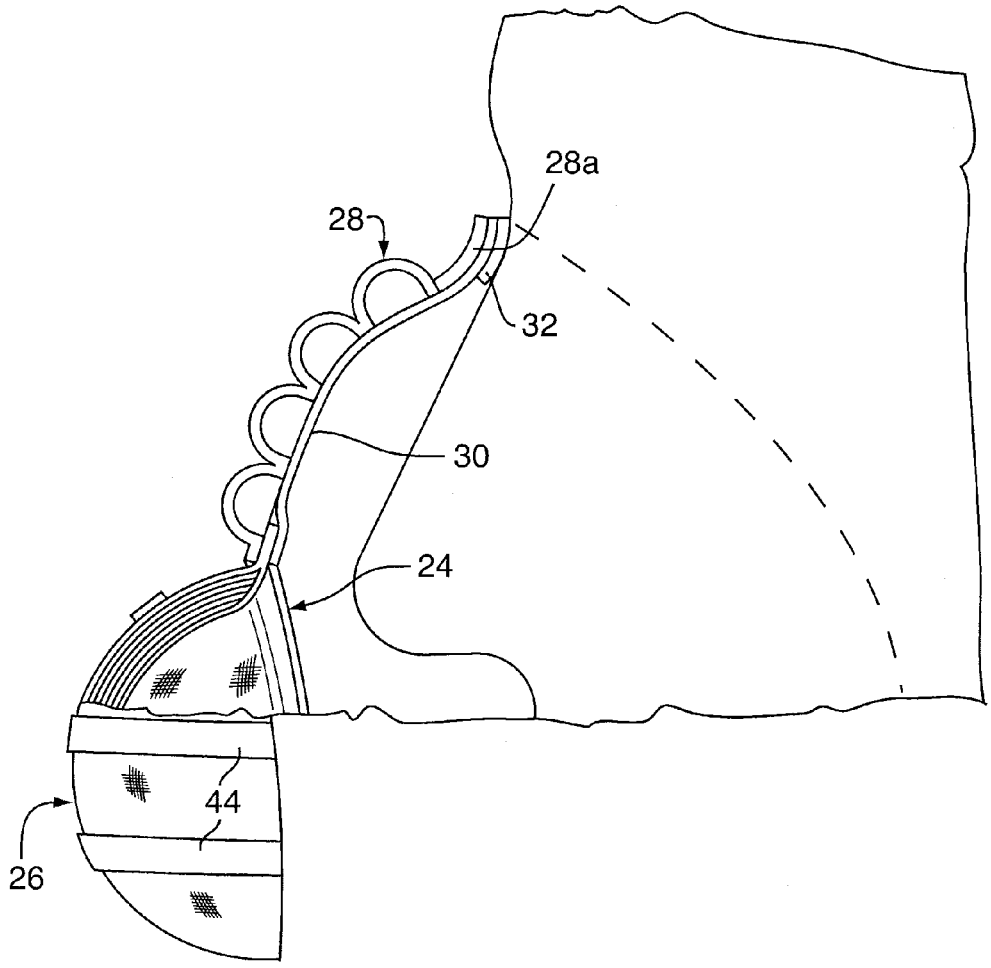
FIG. 6 is a vertical sectional view through the mask as seen in FIG. 4.

In summary, the mask shown in the drawings is a respiratory etiquette device for protecting third parties against the spread of germs. The mask is normally kept in a person's pocket or purse in its compacted configuration and is preferably constrained in the user's closed hand as shown in FIG. 1. When the user feels a sneeze or cough coming on, the mask is withdrawn and allowed to spring open to its erected configuration. The user then places the mask over the nose and mouth as shown in FIG. 6. The polypropylene core of the mask is moisture impervious and will contain material expelled from the nose and/or mouth of the wearer when the sneeze or cough occurs. At the same time, resultant excess air within the mask is released through the filter and the filter itself prevents or at least minimizes any expulsion of material through the mask opening 24.

It will of course be appreciated that the preceding description relates to a particular preferred embodiment of the invention and that many modifications are possible. A number of these modifications have been indicated previously and others will be apparent to a person skilled in the art.

The invention claimed is:

1. A respiratory etiquette device in the form of a mask having a plastic core comprising an impervious sheet or film which is moulded in a shape for covering the mouth and nose of a wearer when the mask is in an erected configuration, the mask being crushable to a compacted configuration in which the mask can be constrained when not in use, the core having an outer surface and the sheet or film being formed to provide an array of raised areas in said outer surface for causing the mask to return to its erected configuration when unconstrained, the mask being impervious to outward expulsion of material from the mouth and/or nose of a user in sneezing or coughing, and including an opening that is closed by a filter for allowing release of excess air from a sneeze or cough.

2. A device as claimed in claim 1, wherein the array of raised areas covers substantially the entire outer surface of the core.

3. A device as claimed in claim 1, wherein the raised areas within the array have geometric shapes.

4. A device as claimed in claim 3, wherein the raised areas are of circular shape in elevation and domed as seen in three dimensions.

5. A device as claimed in claim 4, wherein the circular raised areas are arranged in concentric rings extending around the opening in the mask that is closed by a filter.

6. A respiratory etiquette device in the form of a mask comprising a plastic core which is moulded in a shape for covering the mouth and nose of a wearer when the mask is in an erected configuration, the mask being crushable to a compacted configuration in which the mask can be constrained when not in use, the core having an outer surface formed with an array of raised areas for causing the mask to return to its erected configuration when unconstrained, the mask being impervious to outward expulsion of material from the mouth and/or nose of a user in sneezing or coughing, and including an opening that is closed by a filter for allowing release of excess air from a sneeze or cough, wherein the raised areas are circular and arranged in concentric rings extending around the opening in the mask that is closed by a filter and wherein the circular raised areas are of increasing diameter in successive rings in the radially outward direction.

7. A device as claimed in claim 1, wherein the raised areas are of annular shape and extend concentrically around the opening in the mask.

8. A device as claimed in claim 1, wherein the mask has a generally conical shape with a circular open end for contact with the face of a user.

* * * * *